US008387341B2

(12) United States Patent
Moore et al.

(10) Patent No.: US 8,387,341 B2
(45) Date of Patent: Mar. 5, 2013

(54) CONVERTIBLE APPLICATING MACHINE

(75) Inventors: Kevin D. Moore, Hoopeston, IL (US); Christopher J. Samaras, Mokena, IL (US)

(73) Assignee: Illinois Tool Works Inc., Glenview, IL (US)

( * ) Notice: Subject to any disclaimer, the term of this patent is extended or adjusted under 35 U.S.C. 154(b) by 500 days.

(21) Appl. No.: 12/688,591

(22) Filed: Jan. 15, 2010

(65) Prior Publication Data

US 2010/0192512 A1 Aug. 5, 2010

Related U.S. Application Data

(60) Provisional application No. 61/149,266, filed on Feb. 2, 2009.

(51) Int. Cl.
*B65B 21/24* (2006.01)

(52) U.S. Cl. ..... 53/48.1; 53/55; 53/64

(58) Field of Classification Search ..... 53/398, 53/443, 52, 55, 64, 48.1, 48.3, 48.2
See application file for complete search history.

(56) References Cited

U.S. PATENT DOCUMENTS

| | | | | |
|---|---|---|---|---|
| 5,088,269 | A * | 2/1992 | Thelen | 53/398 |
| 5,188,580 | A * | 2/1993 | Rutledge et al. | 493/225 |
| 5,383,836 | A * | 1/1995 | Long | 493/342 |
| 5,602,747 | A * | 2/1997 | Rajala | 700/122 |
| 5,671,588 | A * | 9/1997 | Chan et al. | 53/398 |
| 6,588,173 | B1 * | 7/2003 | Moore et al. | 53/48.4 |
| 6,928,794 | B2 * | 8/2005 | Hamer et al. | 53/450 |
| 7,637,077 | B2 * | 12/2009 | Slovik et al. | 53/48.4 |
| 2007/0261373 | A1 * | 11/2007 | Slovik et al. | 53/474 |

FOREIGN PATENT DOCUMENTS

| | | |
|---|---|---|
| EP | 0 870 680 A1 | 10/1998 |
| GB | 2 055 738 A | 3/1981 |

* cited by examiner

*Primary Examiner* — Christopher Harmon
(74) *Attorney, Agent, or Firm* — Pauley Petersen & Erickson

(57) ABSTRACT

A machine for packaging multiple containers wherein a flexible carrier stock is fed across a jaw drum. A plurality of containers are also moved through the machine whereby the carrier is subsequently positioned over the plurality of containers so that flexible carrier stock engages with one of the containers to form a package. The jaw drum and/or a connected feed drum are preferably adjustable to accommodate a range of container sizes and carrier configurations.

16 Claims, 5 Drawing Sheets

CONVERTIBLE APPLICATING MACHINE

CROSS REFERENCE TO RELATED APPLICATION

This application claims the benefit of U.S. Provisional Application No. 61/149,266 filed on 2 Feb. 2009. This Provisional Application is hereby incorporated by reference herein in its entirety and is made a part hereof, including but not limited to those portions which specifically appear hereinafter.

BACKGROUND OF THE INVENTION

1. Field of the Invention

This invention relates to a machine for unitizing a plurality of containers using a flexible container carrier.

2. Description of Prior Art

Container carriers connect two or more containers into a sturdy unitized package of containers. Carriers are generally planar arrays of rings, sometimes referred to as "six-pack carriers," typically formed from a thermoplastic sheet material. Carriers are applied to containers of various sizes and shapes along various points along the sidewall or under the chime of the container. A preferable machine would be capable of application of a container carrier to a wide range of container sizes.

Conventional carriers are arranged in aligned arrays of longitudinal rows and transverse ranks of container receiving apertures. A common arrangement is two rows of three ranks of longitudinally and transversely aligned container receiving apertures forming six total container receiving apertures and a "six-pack." Other common configurations include two rows of four ranks forming an eight container multipackage and three rows of four ranks forming a twelve container multipackage.

Conventional applicating machines generally include a circular jaw drum used to apply carriers to individual containers. The conventional jaw drum is typically fixed into position on the applicating machine and fed with a reel or box of a generally continuous container carriers. Such conventional applicating machines typically include an infeed conveyor for supplying a plurality of containers.

The string of carriers are then traditionally applied to the containers and, following application, cut into a desired package configuration. The resulting package is then fed into a turner-diverter that moves and/or rotates the package to a correct position for placement on a pallet or similar shipping unit.

Prior art applicating machines, systems and methods generally require several different versions or configurations of machines to accommodate different container carrier, package sizes and package configurations. Machines are traditionally a limitation on the range of container diameters, size of package or configuration of package that can be effectively packaged by a single system.

Finally, different machines or complex set-up procedures would also be required for containers having different sizes, heights and/or widths, resulting in different lengths, called "pitch" herein, between each adjacent container. As such, different machines and/or set-up procedures are traditionally required to bring the carrier to the correct position around the container.

SUMMARY OF THE INVENTION

A machine for packaging multiple container sizes, using multiple container carriers and/or multiple package sizes includes a carrier that moves through a jaw drum. The carrier is positioned around a perimeter of the jaw drum, and rotates onto uniform groups of containers. The containers are assembled and unitized in a single package. After a brief set-up period, a uniform group of containers having a second physical size requiring a second container carrier size may be packaged with the machine according to this invention.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
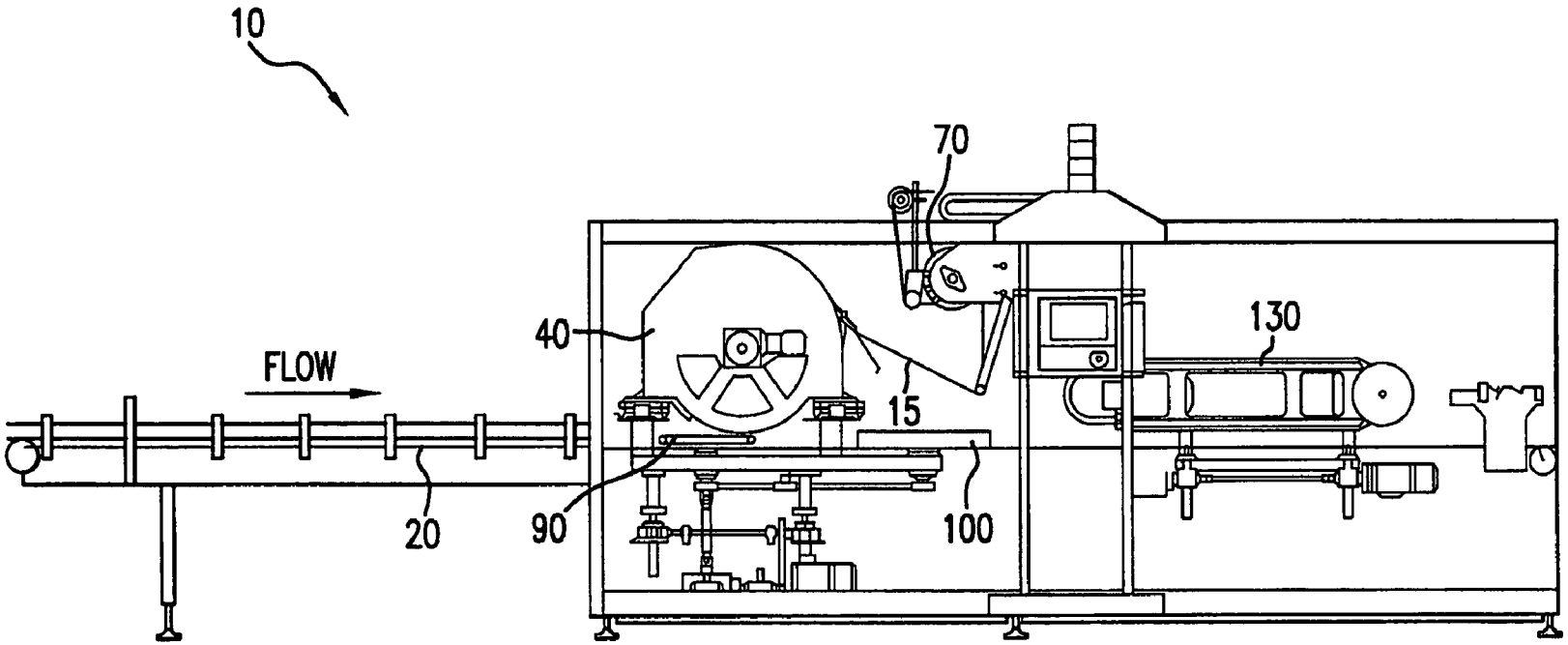
FIG. 1 is a side view of a machine for packaging containers according to one preferred embodiment of this invention.

FIG. 1 shows a machine for packaging multiple containers in a carrier according to one preferred embodiment of this invention. As shown, carrier stock 15 moves through machine 10, specifically through jaw drum 40, where it is applied to containers and then separated into individual, unitized packages. According to one preferred embodiment of this invention, if a uniform group of like-sized containers having a different size requires packaging and/or if a different carrier is required, a separate machine is unnecessary as machine 10 may be quickly reconfigured, following various adjustments to machine 10, as described below.

Therefore, the machine 10 for packaging multiple containers in multiple size packages according to this invention permits the use of a single machine in combination with a variety of sizes of containers and/or sizes and configurations of carriers and/or packages. Traditional machines are typically fifteen or more feet long and six or more feet wide, therefore a reduction in the number of machines required in a packaging plant significantly reduces the required working floor space within the plant. In addition, quick and generally toolless set-up and changeover results in more efficient packaging operations.

Carrier preferably moves through machine 10 from a reel where carriers are dispersed in a continuous string of carrier stock 15 and ultimately to packages where each carrier is separated into a unitized package, each package containing a plurality of uniform containers. A typical configuration for a package is a "six-pack" containing two longitudinal rows of containers in three transverse ranks. Additional desired packages such as four-packs, eight packs and twelve packs may be unitized using machine 10 according to this invention, and such additional sizes of packages are limited only by the consumer market for such additional sizes.

Carrier (and carrier stock) is preferably constructed from a flexible plastic sheet, such as low-density polyethylene. The flexible plastic sheet is punched or otherwise formed into a plurality of container receiving apertures aligned in transverse ranks and at least two longitudinal rows to form a continuous sheet of carriers. The container receiving apertures are preferably oriented in a longitudinal direction with respect to carrier. Carrier may also include features such as a handle for holding carrier along either a side or a top of the package and/or a merchandising panel for displaying product and/or promotional information. Additionally, features such as tear tabs and perforations may be included in the carrier to ease removal of the containers from carrier.

According to one preferred embodiment of this invention, machine 10 for packaging multiple containers includes moving carrier stock 15 through machine 10 from a reel stand (not shown). Carrier stock 15 then enters machine 10 across feed drum 70 and into jaw drum 40. Following application to containers, carrier stock 15 is divided into individual carriers using cutoff wheel 100 resulting in individually unitized packages of a desired size which are then dispersed to a case packer (not shown) using turner/diverter 130. Feed drum 70 and jaw drum 40 of machine 10 are described in detail in the following description of preferred embodiments of this invention, including features that permit machine 10 to address a wide range of packaging requirements.

Machine 10 includes an input conveyor 20 for conveying the containers longitudinally into a platform of machine 10, in preferably two longitudinal rows, and an output conveyor 30 for conveying the containers longitudinally from the platform after the carrier stock has been applied. According to a preferred embodiment of this invention, star wheel 90 is positioned on each side of machine 10 to accept containers from input conveyor 20. Star wheel 90 serves to locate the containers for proper application of carrier stock 15 to such containers. The plurality of containers moves through machine 10 and each container is spaced apart from an adjacent container by star wheel 90. The spacing between adjacent containers as they enter machine 10 depends upon the relative sizing and configuration of star wheel 90 which may be exchangeable and/or sized to accommodate the largest diameter container to be used in machine 10. Star wheel 90 may be replaceable with substitute star wheels having a different thickness or different surface geometry, such as to accommodate non-conventional container shapes, such as contoured cans. As discussed in more detail below, carrier stock 15 is subsequently positioned over the plurality of containers whereby each container receiving aperture engages with one of the containers to form a package having a predetermined number of containers.

Jaw Drum

Figure 2:
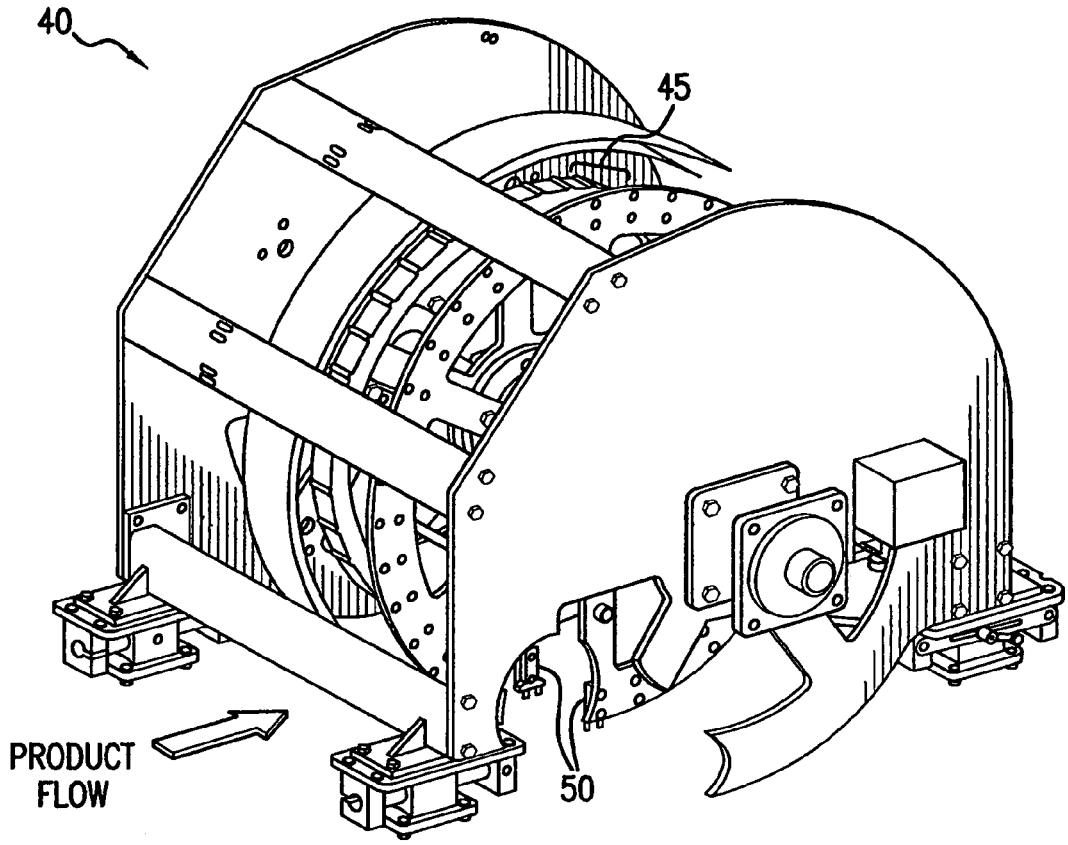
FIG. 2 is a side perspective cutaway view of a jaw drum according to one preferred embodiment of this invention.
Figure 3:
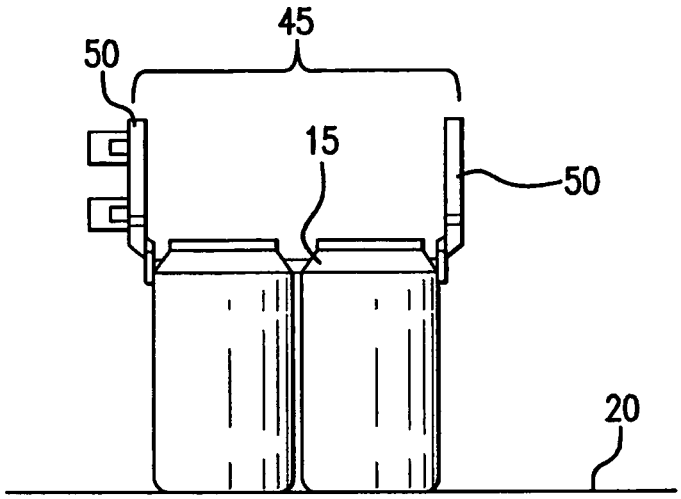
FIG. 3 is a front schematic view of the jaw drum relative to a plurality of containers.
Figure 4:
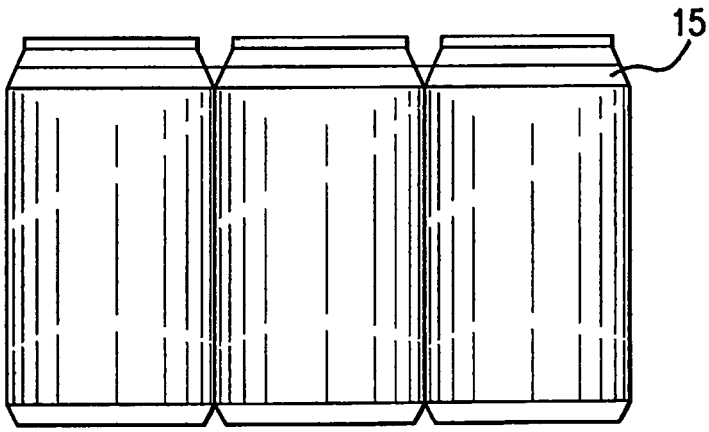
FIG. 4 is a side view of a package of containers using a rim-applied carrier configuration.

The plurality of containers proceed from star wheel 90 to beneath jaw drum 40, as shown in FIG. 2, for application of carrier stock 15 around the containers, such as shown in FIG. 3, resulting in a unitized package shown in FIG. 4. Carrier stock 15 proceeds from feed drum 70, discussed in more detail below, to jaw drum 40, particularly to jaw pairs 45 located radially about jaw drum 40. Jaw drum 40, such as shown in FIG. 2, preferably comprises a cylindrical member rotatable about a horizontal axis which transports carrier stock 15 from feed drum 70 to the plurality of containers which flow through jaw drum 40. A plurality of jaw pairs 45 are preferably equally spaced around a perimeter of jaw drum 40. Radial positions of jaw pairs 45 around the perimeter of jaw drum 40 are preferably permanently fixed.

According to one preferred embodiment of this invention, each jaw pair 45 is movable between a closed position and an open position along an axis parallel to the horizontal axis of rotation of jaw drum 40. The closed position comprises a relative position of jaw pair 45 when a moveable jaw is in a closest desired position relative to a fixed jaw. The open position comprises a relative position of jaw pair 45 when the moveable jaw is in a farthest desired position relative to the fixed jaw. As a result of a cammed relationship between the fixed jaw and the moveable jaw, the relative position of the moveable jaw with respect to the fixed jaw changes as jaw drum 40 is rotated through a full 360° rotation.

Each jaw pair 45 is configured to grip carrier stock 15 through each transverse pair of container receiving apertures in carrier stock 15. The circumferential spacing between adjacent jaw pairs 45 is preferably approximately equal to a pitch of carrier, i.e., the distance between adjacent centers of container receiving openings. The lateral spacing between the moveable jaw and the fixed jaw in the closed position is preferably slightly less than a width between transverse pairs of container receiving apertures. Carrier stock 15 is engaged with jaw pairs 45 of jaw drum 40 immediately prior to application to containers.

Figure 5:
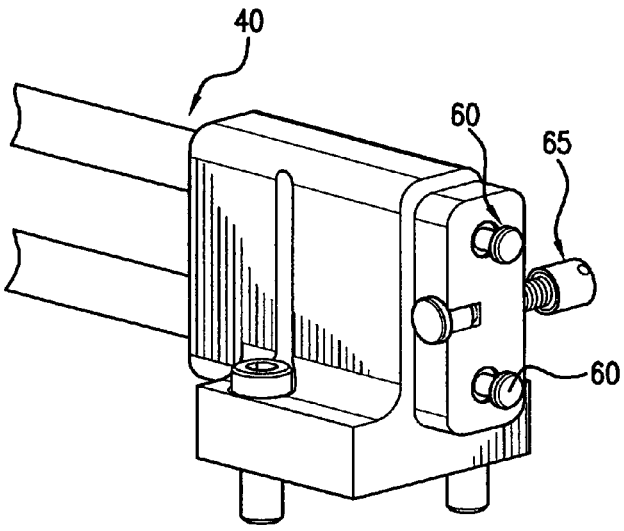
FIG. 5 is a side perspective view of a portion of a jaw drum according to one preferred embodiment of this invention.
Figure 6:
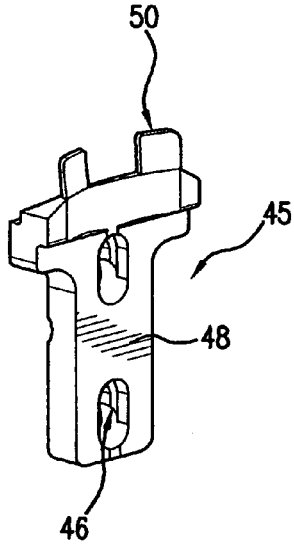
FIG. 6 is a side perspective view of a first jaw according to one preferred embodiment of this invention.
Figure 7:
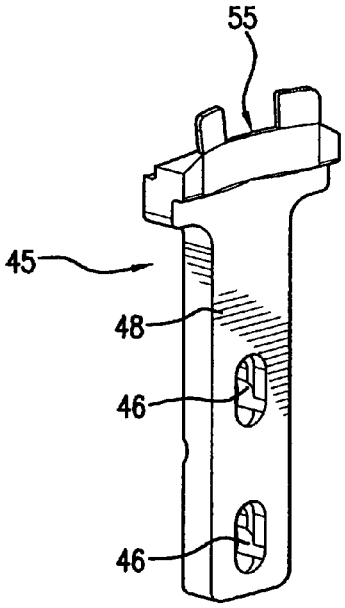
FIG. 7 is a side perspective view of a second jaw according to one preferred embodiment of this invention.

As such, jaw drum 40 is adapted to draw the flexible carrier stock 15 from feed drum 70 and apply the flexible carrier stock 15 to the plurality of containers. According to a preferred embodiment of this invention, jaw pairs 45 preferably comprise a plurality of first removable jaws 40 connected around a circumference of jaw drum 40, such as shown in FIGS. 2, 3 and 5. The plurality of first removable jaws 50 are preferably exchangeable with plurality of second removable jaws 55, such as shown in FIG. 7. According to one preferred embodiment of this invention, second removable jaws 55 include a different jaw height than first removable jaws 50. More particularly, as shown in FIGS. 6 and 7, second removable jaws 55 include a greater jaw height than first removable jaws 50.

According to one preferred embodiment of this invention, a plurality of pairs of locating pins 60 positioned around the circumference of jaw drum 40, each pair of locating pins 60 removably receiving a first removable jaw 50 or a second removable jaw 55 of the jaw pairs 45. Each jaw pair 45 preferably further includes a pair of slots 46 formed in body 48 of a respective removable jaw 50, 55 for engaging the pair of locating pins 60 on jaw drum 40.

As shown in FIG. 5, jaw drum 40 and/or jaw pairs 45 may further include retaining pin 65 biasing removable jaws 50, 55 into position on jaw drum 40. Retaining pin 65 may be spring loaded or otherwise biased so as to facilitate placement and removal of jaw pairs 45 with respect to jaw drum 40. Preferably, jaw pairs 45 are removable and replaceable in a tool-less manner by simply manually manipulating retaining pin 65 to release each jaw of the respective removable jaws 50, 55 from jaw drum 40.

Figure 8:
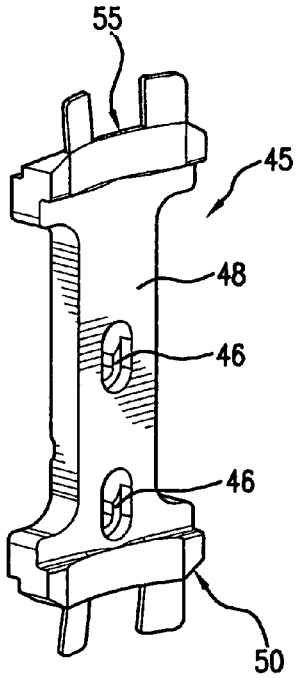
FIG. 8 is a side perspective view of a reversible jaw according to one preferred embodiment of this invention.

According to a preferred embodiment of this invention shown in FIG. 8, each jaw of jaw pairs 45 may comprise a jaw having first removable jaws 50 and second removable jaws 55 located on opposite ends of a common body 48. In such a manner, a respective jaw may be reversed on jaw drum 40 depending on whether first removable jaws 50 or second removable jaws 55 are desired for the particular application.

Figure 9:
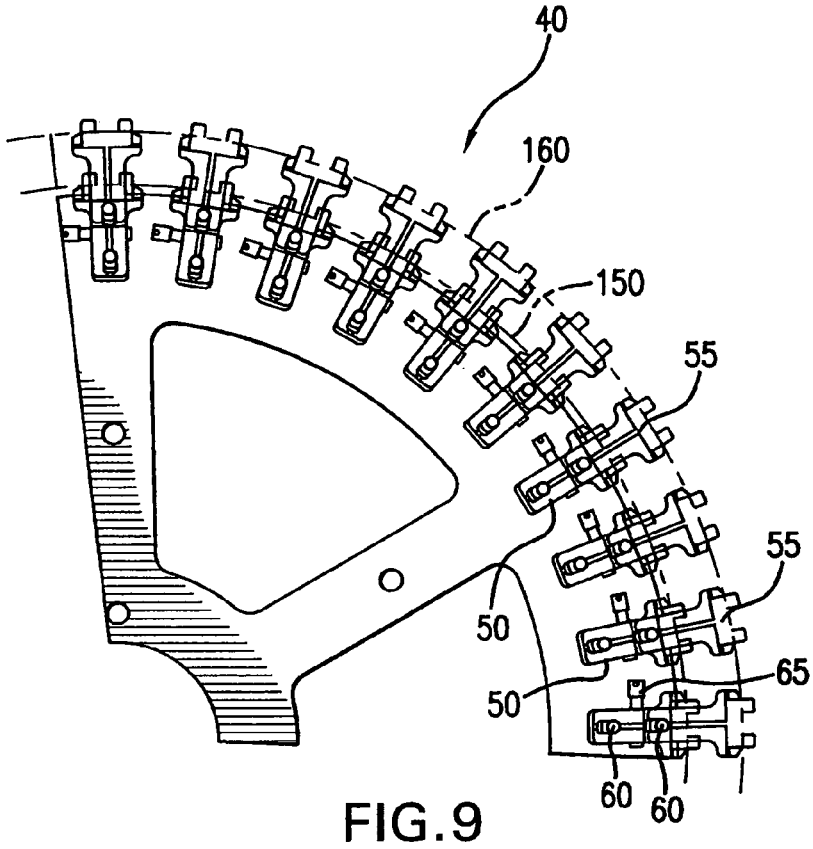
FIG. 9 is a side schematic view of the positions of first jaws and second jaws on a jaw drum relative to containers having a first pitch and a second pitch, respectively.

FIG. 9 schematically shows the result of replacing first removable jaws 50 with second removable jaws 55. As shown, first removable jaws 50 having a first jaw height result in a first pitch 150. Likewise, second removable jaws 55 having a second, greater jaw height result in second pitch 160. As a result, a first set of containers having first pitch 150, or distance between centers of adjacent containers, may be packaged using jaw drum 40. Should a second set of containers having a second pitch 160 be desired, then second removable jaws 55 may replace first removable jaws 50 for setting the desired pitch. In this manner, larger diameter containers, having the second pitch 160, may be packaged on the same machine as a smaller diameter containers having the first pitch 150.

As jaw pairs 45 move with the rotation of jaw drum 40 from a closed position to an open position, container receiving apertures within carrier stock 15 stretch to accommodate a container. Carrier stock 15 in a stretched condition is positioned over a plurality of containers so that each container receiving aperture engages with one container. Upon engagement with the containers, carrier stock 15 is released from jaw pair 45 and grips a perimeter of container, either around a chime in a rim-applied carrier (RAC) configuration, such as shown in FIG. 4, or around a sidewall in a sidewall-applied carrier (SAC) configuration (not shown).

FIG. 3 shows a position of jaw drum relative to containers for a RAC configuration. In a RAC configuration, jaw drum 40 is positioned so that jaw pairs 45 properly engage containers to position carrier stock 15 about a chime of each container as shown in FIG. 4. When a larger diameter container requires packaging, jaw pairs 45 may be swapped out, such as between first removable jaws 50 and second removable jaws 55 to create new pitch options as shown schematically in FIG. 9.

Feed Drum

Figure 10:
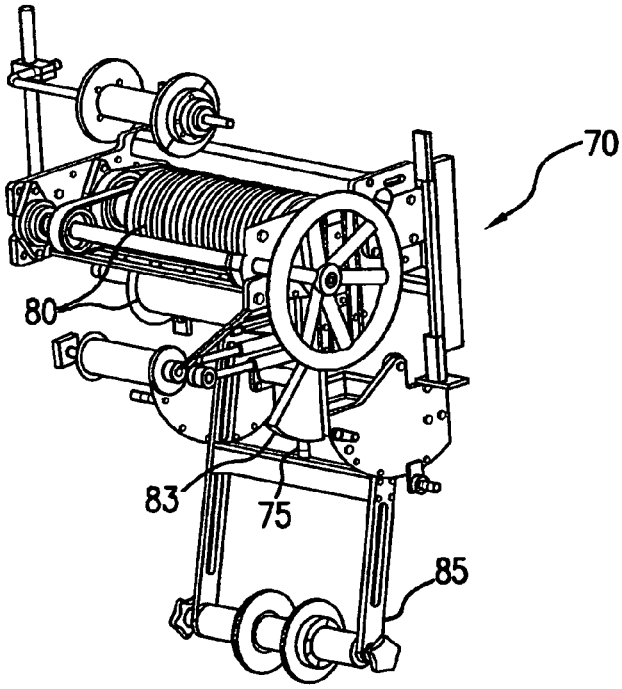
FIG. 10 is a side perspective view of a feed system according to one preferred embodiment of this invention.

As carrier stock 15 is dispersed from reel stands (not shown) to jaw drum 40, feed drum 70 is used to maintain tension in the carrier stock 15. Feed drum 70, as shown in detail in FIG. 10, preferably includes pinch roller 80 connected upstream of jaw drum 40 for feeding the flexible carrier stock 15 to jaw drum 40. Pinch roller 80 may comprise a driven rubber roller clamped against a free metal roller to positively advance carrier stock 15 at a desired speed.

Carrier stock 15 preferably further extends around dancer arm 85 connected with respect to pinch roller 80. Dancer arm 85 preferably measures and maintains a relative tension in carrier stock 15 as it is pulled from the reel stand and advanced to jaw drum 40. Specifically, speed sensor 75 is preferably connected with respect to dancer arm 85 for controlling a speed of pinch roller 80 based upon a speed of jaw drum 40. Cam 83 may be additionally connected with respect to dancer arm 85 and speed sensor 75 for providing carrier stock speed feedback to pinch roller 80.

In this manner, feed drum 70 may provide a proper speed of carrier stock 15 depending on the relative pitch 150, 160 required and the relative size of jaw pairs 45 required. A plurality of first removable jaws 50 may thus correspond with a first plurality of containers having a first pitch 150 and a first application speed and a plurality of second removable jaws 55 may correspond with a second plurality of containers having a second pitch 160 and a second application speed. Speed sensor 75 thereby automatically adjusts a speed of pinch roller 80 based on a desired application speed.

As described above, one or more operative components of machine 10 are preferably adjustable to permit packaging of containers having different sizes, such as heights and diameters and carriers having different sizes. In each of these different applications, multiple components of machine 10 may be adjusted, replaced and/or interchanged to permit application of carrier stock 15 to containers.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A machine for packaging a plurality of containers into packages using flexible carrier stock, the machine comprising:

a feed drum adapted to feed the flexible carrier stock;

a jaw drum adapted to draw the flexible carrier stock from the feed drum and apply the flexible carrier stock to the plurality of containers;

a plurality of first removable jaws connected around a circumference of the jaw drum, the plurality of first removable jaws exchangeable with plurality of second removable jaws, the second removable jaws having a different jaw height than the first removable jaws, wherein the first removable jaws and the second removable jaws are located on opposite ends of a common body.

2. The machine of claim 1 further comprising:

a plurality of pairs of locating pins positioned around the circumference of the jaw drum, each pair of locating pins removably receiving a first removable jaw of the plurality of first removable jaws.

3. The machine of claim 2 further comprising:

a pair of slots formed in the first removable jaw for engaging the pair of locating pins.

4. The machine of claim 1 wherein the first removable jaws correspond with a first plurality of containers having a first pitch and the second removable jaws correspond with a second plurality of containers having a second pitch.

5. The machine of claim 1 further comprising:

a retaining pin biasing the first removable jaws into position on the jaw drum.

6. A machine for packaging a plurality of containers into packages using flexible carrier stock, the machine comprising:

a feed drum adapted to feed the flexible carrier stock, the feed drum further including a pinch roller connected with respect to the jaw drum for feeding the flexible carrier stock to the jaw drum;

a dancer arm connected wtih the pinch roller; and a speed sensor connected wtih respect to the dancer arm for controlling a speed of the pinch roller based upon a speed of the jaw drum;

a jaw drum adapted to draw the flexible carrier stock from the feed drum and apply the flexible carrier stock to the plurality of containers;

a plurality of first removable jaws connected around a circumference of the jaw drum, the plurality of first removable jaws exchangeable with plurality of second removable jaws, the second removable jaws having a different jaw height than the first removable jaws.

7. The machine of claim 6 wherein the pinch roller comprises a driven rubber roller clamped against a free metal roller.

8. The machine of claim 6 further comprising:

a cam connected with respect to the dancer arm, the cam connected with respect to the speed sensor for providing carrier stock speed feedback.

9. A machine for packaging a plurality of containers using flexible carrier stock, the machine comprising:

a jaw drum adapted to draw the flexible carrier stock and apply the flexible carrier stock to the plurality of containers;

a pinch roller connected with respect to the jaw drum for feeding the flexible carrier stock to the jaw drum;

a dancer arm connected with the pinch roller; and a speed sensor connected with respect to the dancer arm for controlling a speed of the pinch roller based upon a speed of the jaw drum;

a plurality of locating pin pairs positioned around the jaw drum; and a plurality of removable jaws, each removable jaw of the plurality of removable jaws positioned on a locating pin pair of the plurality of locating pin pairs.

10. The machine of claim 9 wherein the jaw drum further comprises:

a retaining pin biased against each removable jaw for tool less removal of the plurality of removable jaws.

11. The machine of claim 9 further comprising:

a plurality of first removable jaws; and a plurality of second removable jaws exchangeable with the plurality of first removable jaws, the second removable jaws having a different jaw height than the first removable jaws.

12. The machine of claim 9 wherein each removable jaw of the plurality of removable jaws comprise a first removable jaw and a second removable jaw located on opposite ends of a common body.

13. The machine of claim 9 further comprising:

a plurality of first removable jaws corresponding with a first plurality of containers having a first pitch and a first application speed; and a plurality of second removable jaws corresponding with a second plurality of containers having a second pitch and a second application speed, the speed sensor automatically adjusting the speed of the pinch roller based on a desired application speed.

14. A system for packaging a plurality of containers into packages using flexible carrier stock, the system comprising:

a jaw drum drawing the flexible carrier stock for application to the plurality of containers, the jaw drum having a plurality of interchangeable and removable jaws;

a feed drum feeding the flexible carrier stock to the jaw drum, the feed drum including a pinch roller for deeding the flexible carrier stock, a speed sensor connected with respect to the pinch roller for controlling a speed of the pinch roller based upon a speed of the jaw drum, and a dancer arm connected with the pinch roller for maintaining a desired tension in the flexible carrier stock.

15. The system of claim 14 further comprising:

a plurality of second removable jaws; and a plurality of second removable jaws exchangeable with the plurality of first removable jaws, the second removable jaws having a different jaw height than the first removable jaws.

16. The machine of claim 14 wherein each removable jaw of the plurality of removable jaws comprise a first removable jaw and a second removable jaw located on opposite ends of a common body.

* * * * *